United States Patent [19]

Shahar

[11] 4,280,677

[45] Jul. 28, 1981

[54] SHUTTERING

[76] Inventor: Moshe Shahar, 34 Semadar St., Ramath Gan, Israel

[21] Appl. No.: 35,551

[22] Filed: May 3, 1979

[51] Int. Cl.[3] ..... E04G 11/10; E04G 17/02

[52] U.S. Cl. ..... 249/43; 249/47; 249/190; 249/192; 249/194; 249/210; 249/219 R

[58] Field of Search ..... 249/219 R, 25, 27, 45, 249/47, 48, 192, 43, 190, 194, 210

[56] References Cited

U.S. PATENT DOCUMENTS

| | | | |
|---|---|---|---|
| 1,164,335 | 12/1915 | Engstrom | 249/219 R |
| 1,217,416 | 2/1917 | Colt | 249/27 |
| 1,290,646 | 1/1919 | Novy | 249/219 R |
| 1,538,496 | 5/1925 | Wells | 249/192 |
| 1,603,748 | 10/1926 | Davis | 249/219 R |
| 2,004,462 | 6/1935 | Bush | 249/27 |
| 2,296,782 | 9/1942 | Fischer et al. | 249/192 |
| 2,441,178 | 5/1948 | Abbott | 249/219 R |
| 2,549,758 | 4/1951 | Cotner | 249/192 |
| 2,871,619 | 2/1959 | Walters | 249/192 |
| 3,011,242 | 12/1961 | Matheson | 249/219 R |
| 3,288,427 | 11/1966 | Pluckebaum | 249/45 |
| 3,795,381 | 3/1974 | Argust | 249/219 R |
| 3,851,850 | 12/1974 | Hixon | 249/219 R |
| 3,857,540 | 12/1974 | Ecker | 249/219 R |
| 3,948,503 | 4/1976 | Weber | 249/219 R |
| 4,029,288 | 6/1977 | Murphy et al. | 249/219 R |
| 4,033,548 | 7/1977 | Shahar | 249/219 R |
| 4,158,452 | 6/1979 | Gates | 249/219 R |

FOREIGN PATENT DOCUMENTS

| | | | |
|---|---|---|---|
| 241134 | 3/1960 | Australia | 249/219 R |
| 801472 | 1/1951 | Fed. Rep. of Germany | 249/25 |
| 855426 | 2/1940 | France | 249/219 R |
| 52876 | 7/1979 | Israel | 249/196 |
| 562880 | 5/1957 | Italy | 249/25 |
| 625024 | 9/1961 | Italy | 249/219 R |

*Primary Examiner*—John C. Bleutge
*Assistant Examiner*—Arthur H. Koeckert
*Attorney, Agent, or Firm*—Browdy and Neimark

[57] ABSTRACT

A shuttering for casting therein concrete structures is composed of panels, a set comprising at least two panels each of which is provided along at least one edge thereof with two parallel grooves in combination with at least one rail for connecting the panels such rail having profiled portions fitting into either of the grooves, means being provided on the said rail for forcibly urging the panels towards one another whenever the said profiled portions of the rail are engagingly inserted in the grooves of the two panels.

7 Claims, 9 Drawing Figures

FIG.1
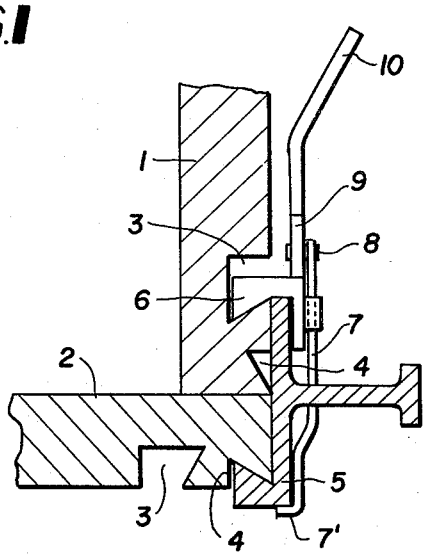
FIG.2
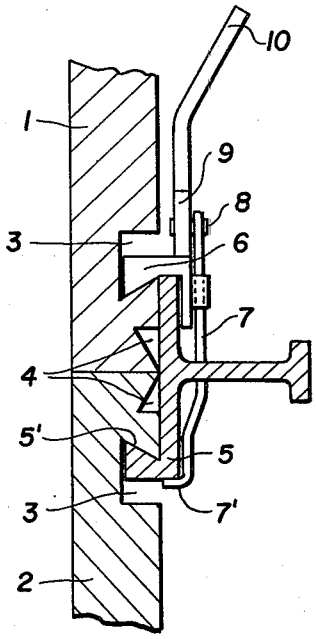
FIG.3
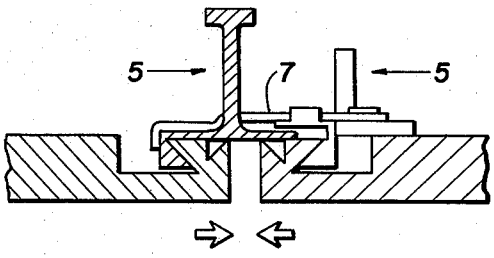
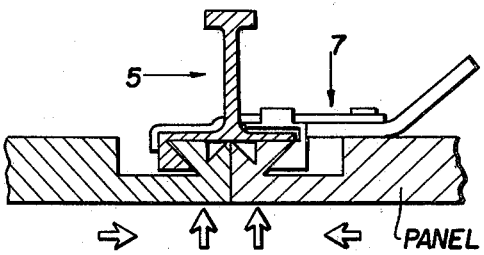
FIG.4
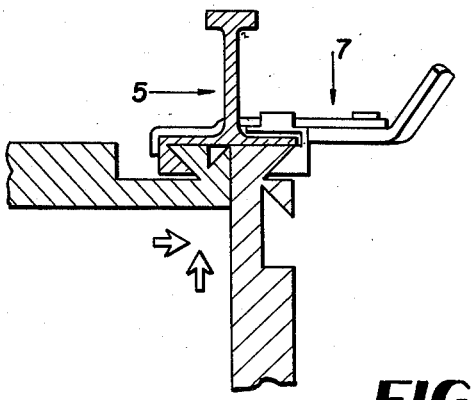
FIG.5

SHUTTERING

BACKGROUND OF THE INVENTION

The present invention relates to an improvement of the shutterings described in my U.S. Pat. No. 4,033,548.

As becomes clear from that specification panels are provided with grooves extending near an edge of a panel and two panels laid side by side with their grooves in parallel are firmly connected by means of a rail of a specific profile which inlcudes "tongue portions" engaging in the said groove. In the construction according to the said patent application different means have to be provided for panels to be connected co-planarly and for those to be connected at an angular relation to one another. Co-planar connections are employed for shutterings used in casting the major face of a wall or the like; the angular connection is required when the corner of a building structure, or a pillar is to be cast.

A further improvement concerns the following: As has been explained in the description of the invention according to my said above application the rails may be slid lengthwise into the grooves provided in the panels. For certain purposes and in some location such sliding in of the rails would at least be awkward, if not impossible. Therefore it had been proposed to make the tongues on the rails narrower across than the grooves into which they are to be inserted. Thus a narrow tongue may enter a groove o a panel sideways, eliminating thereby the need of sliding in a long rail the length of which might make this operation difficult.

In such a case clamping means are required to forcibly urge together the rails in the grooves of two vicinal panels. The present application relates to such an improved clamping means.

Incidentally, such clamps can fulfil a further, important task.

OBJECTS OF INVENTION

It is the object of the present invention to provide panels and connecting rails which may be used as shutterings for concrete structures to be cast therein, the panels being connectable by means of the same rails, both co-planarly and in angular relation to one another.

It is a further object of the invention to provide an improved clamp for the purpose referred to above.

BRIEF SUMMARY OF THE DISCLOSURE

According to the present improvement each panel is provided along at least one edge thereof with two parallel grooves and the rails for connecting the panels are provided with profiled portions fitting into either of the grooves, means being provided on the said rails for forcibly urging the panels towards one another whenever the said profiled portions of the rails are engagingly inserted in the grooves of the two panels.

SHORT DESCRIPTION OF DRAWINGS

The invention will now be described in detail with reference to the accompanying drawings, wherein the new construction is shown schematically.

FIGS. 1 and 2 are both cross sectional views of the improved panel connections. FIG. 1 shows the angular relative position and FIG. 2 the co-planar position of connected panels.

FIGS. 3, 4 and 5 illustrate schematically the improved connection.

DETAILED DESCRIPTION OF PREFERRED EMBODIMENTS

Figure 9:
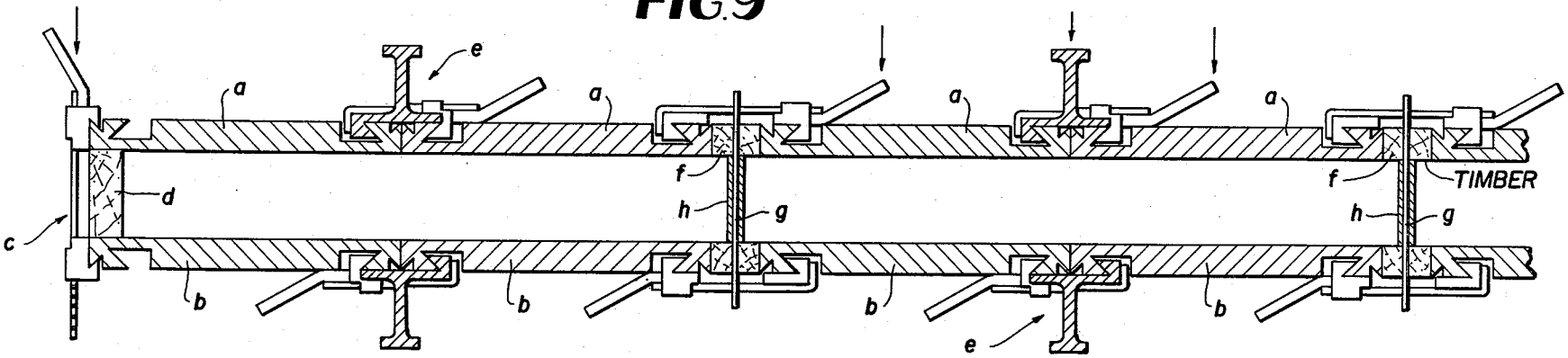
FIG. 9 illustrates schematically an incidental, additional use of the new clamps.

Turning first to FIGS. 1 and 2: Two panels 1 and 2 are each provided near an edge thereof with two parallel grooves 3 and 4. Groove 3 is undercut (but need not be so) while groove 4 is a V-groove (but need not be so).

A rail 5 having a profiled tongue 5' can engage with that portion 5' in either of grooves 3 or 4. A profiled tongue member 6 is of same profile as portion 5' and thus can also engage in either of the two grooves. To member 5 is attached a bar 7, the end 7' of which is formed as a presser foot. To bar 7 is turnably—about an axis 8—affixed a cam 9 which can be turned by a handle 10.

In FIG. 1 "tongue" portion 5' engages in groove 4 of panel 2, while member 6 engages in groove 3 of panel 1. The panels 1 and 2 are positioned to define a right angle between them. Presser foot 7' lies against the outside of portion 5'. The cam 9 lies against the rear of member 6. By turning the cam 9 by means of handle 10 strong pressure is exerted on both, member 6 and portion 5' (onto the latter by presser foot 7'), thereby firmly urging the two panels 1 and 2 against one another and rigidly connecting them.

In FIG. 2 the two panels are placed in a common plane and abut against one another with their edges. In this case both portions 5' and member 6 engages in groove 3 of panels 1 and 2. Again pressure is exerted by means of cam 9 as had been described above.

It will be seen that identical panels with identical grooves can now be connected with one another in different relative positions.

There are possible certain variations of construction without departing from the gist of the invention. While the cam mechanism shown and described permits a quick and secure connection, it would be possible to use different means. So e.g. pressure might be exerted by screw means or by clamps urging the panels towards one another.

Equally the profiles of portion 5' and member 6 may be different, say square—in which case the grooves 3 and 4 will be of corresponding cross sectional shape.

The rails 5 and 6 may be of whatever length.

As can be seen from FIGS. 3 and 4, the rails are inserted sideways into the grooves. Then by means of bar 7 and presser foot 7' which are actuated by cam 9, the two panels are forcibly pulled together (as indicated by the arrows in FIGS. 3 and 4).

At the same time pressure is exerted on both panels in the direction of the upwardly pointing arrows in FIG. 4. As a result the two panels become co-planarly aligned, as is required in a shuttering.

FIG. 5 shows in the same manner the use of the improved connecting means applied to angularly connected panels.

Figure 6:
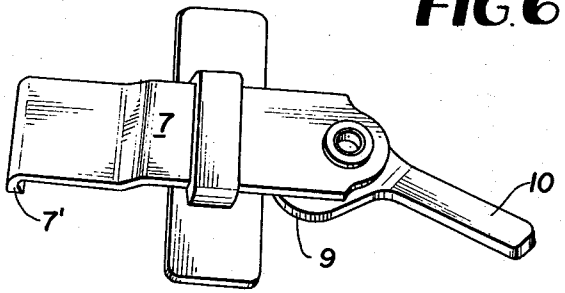
FIG. 6 is a perspective view, on a larger scale of an improved clamp.

The perspective view of FIG. 6 does not require further description, the clamping member having been described in full above.

Figure 7:
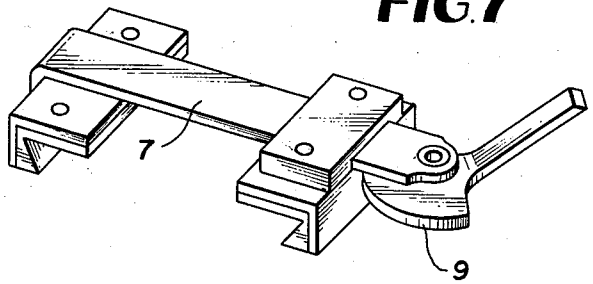
FIG. 7 is a perspective view of a form of such a clamp for special use.

As is well known, the two walls of a shuttering are connected by ties which span the distance between the said two walls. It is common practice to drill holes in the planks which form the shuttering, to provide a hold for the ties. Drilling holes into planks or panels of the kind of this invention would be inconvenient, the panels are destined for repeated use and should not be defaced by drilled holes. It is suggested therefore to interpose between two panels an expendable narrow timber plank or fillet into which holes may be drilled and which can be discarded after one or a few uses. So that this can be done the implement according to FIG. 7 is used. Here the bar 7 is of such a length that it is adapted to span a distance between two panels. In that case a narrow timber strip or fillet can be inserted between the panels and is held therebetween when the panels are forcibly urged towards one another.

It will be understood that the new clamp may either be permanently attached to the rails (as e.g. shown in FIG. 7) or may be a separate unit (as shown e.g. in FIG. 6).

Figure 8:
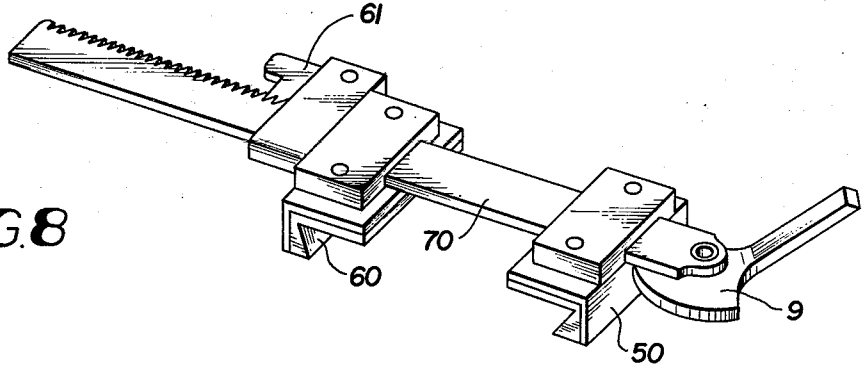
FIG. 8 is a like view of another clamp destined for use in cases where very wide panels are to be held to one another.

Turning now to FIG. 8 here a bar 70, the free end of which is formed as a rack, serves instead of bars 7 described above. One of the rails, indicated by numeral 50 can be urged into clamping position by cam 9. The second rail 60 is shiftable on bar 70 and can be fixed in a desired position by a pawl 61 engaging the rack portion of bar 70. Such devices are well known and require no further elucidation.

FIG. 9 illustrates the use of the devices of FIGS. 7 and 8. At the left hand end of the wall which is cast in a shuttering comprising panels a at one and panels b at the opposite side, a clamping device c is provided. This device is one identical with that shown in FIG. 8. Between the two outermost panels a and b at that end of the shuttering is held a timber plank d constituting the end closure of the shuttering. All panels a and all panels b are clamped together by clamping devices e which are identical with that shown in FIG. 7. Between vicinal panels—both a and b are inserted wooden fillets f and are clampingly held between the edges of the respective panels. Holes are drilled into these fillets—as mentioned above and tie rods g are passed there—through and are secured at the outside of the shuttering by screwed on nut, as is well known. Onto rods g are slipped short pieces of tubes h which serve as distance pieces between opposite panels.

What is claimed is:

1. A set of elements for construction of shutterings in which concrete or like structures can be cast, the set comprising at least two panels each of which is provided adjacent at least one edge thereof with two parallel grooves in a major face thereof; at least one rail means for connecting said at least two panels, said rail means having profiled portions which can be fitted into either of the said grooves in either of said at least two panels to position said two panels in either a co-planar or angular relative position to one another; and means provided on said rail means for forcibly urging said panels toward one another whenever said profiled portions of the rail means are engagingly inserted in any of said grooves in said two panels.

2. A set of elements as claimed in claim 1, wherein said means for forcibly urging said at least two panels toward one another is constituted by a profiled member adapted to engage in one of said grooves in one of said at least two panels, a bar whose end constitutes a presser foot attached to said member and a cam attached to said member, turnably about an axis and having a handle by which is may be turned.

3. A set of elements as claimed in claim 2, wherein said bar is a rack.

4. A shuttering for casting concrete structures built up from elements according to claim 8, comprising oppositely disposed panels constituting opposite walls of the shuttering, at least one end panel extending between two of said oppositely disposed panels near first ends thereof, said at least one end panel being held to said two of oppositely disposed panels by respective profiled rails engaging in grooves extending in said oppositely disposed panels.

5. A shuttering for casting concrete structures assembled from elements of the sets claimed in claim 9, wherein said oppositely disposed panels comprises a plurality of oppositely disposed panels arranged in two planes, and including wooden fillets inserted between ones of said plurality of oppositely disposed panels and in which holes are drilled, said holes in oppositely disposed fillets being in registar, rods passed through said holes in said oppositely disposed fillets and short pieces of tubing slipped on said rods to serves as spacing pieces for said oppositely disposed panels of the shuttering arranged in said two planes.

6. A shuttering for casting concrete structures built up from elements according to either claim 1 or claim 2, comprising oppositely disposed panels constituting opposite walls of the shuttering, at least one end panel extending between two of said oppositely disposed panels near first ends thereof, said at least one end panel being held to respective said two of said oppositely disposed panels by respective profiled rails engaging in grooves extending in said oppositely disposed panels.

7. Shuttering for casting concrete structures assembled from elements of the sets claimed in claim 6, wherein said oppositely disposed panels comprises a plurality of oppositely disposed panels arranged in two planes, and including wooden fillets inserted between ones of said oppositely disposed panels and in which holes are drilled, said holes in oppositely disposed fillets being in registar, rods passed through said holes in said oppositely disposed fillets and short pieces of tubing slipped on said rods to serve as spacing pieces for said oppositely disposed panels of the shuttering arranged in said two planes.

* * * * *